United States Patent [19]

Durant

[11] Patent Number: 4,896,390

[45] Date of Patent: Jan. 30, 1990

[54] LIQUID MIXING PADDLE HAVING DISPOSABLE SLEEVE

[76] Inventor: Will G. Durant, 248 Quincy, Long Beach, Calif. 90803

[21] Appl. No.: 294,238

[22] Filed: Jan. 9, 1989

[51] Int. Cl.[4] ..... B25F 1/00

[52] U.S. Cl. ..... 7/105; 7/151; 366/129; 366/605

[58] Field of Search ..... 7/151, 105, 170; 366/605, 129, 343; 416/70 R, 71; 30/151; 128/23; 604/263

[56] References Cited

U.S. PATENT DOCUMENTS

| | | | |
|---|---|---|---|
| 1,498,509 | 6/1924 | Arnold | 366/129 |
| 2,163,758 | 6/1939 | Mariner | 416/70 |
| 2,254,475 | 10/1950 | Renz . | |
| 2,528,128 | 10/1950 | Forster . | |
| 2,777,676 | 1/1957 | Carter | 366/129 |
| 2,860,858 | 11/1958 | Kurs | 366/129 |
| 2,931,259 | 4/1960 | Nicot . | |
| 3,387,368 | 6/1968 | Scheck | 30/151 |
| 4,071,952 | 2/1978 | Meshulam et al. | 30/151 |
| 4,350,445 | 9/1982 | Olsson | 366/129 |
| 4,553,279 | 11/1985 | Gassew et al. . | |
| 4,580,302 | 4/1986 | Barth . | |

*Primary Examiner*—Roscoe V. Parker
*Attorney, Agent, or Firm*—Leonard Tachner

[57] ABSTRACT

A mixing system for use with paint cans and the like, the mixing system comprising a blade having, in a preferred embodiment, a prying end and a handle which can serve the additional purpose of a mallet. The remaining portion of the blade is adapted for insertion into the pocket of a disposable sleeve, preferably but not necessarily made of paper coated internally with polyethylene or other coating. Such sleeve may also be made of plastic or metal foil. The paper sleeve provides a jacket portion adapted to encircle the blade and a flat portion which may be used for a variety of purposes including calibrating the level of the paint in the can, as well as providing specially shaped edges for wiping the interior lip as well as the bottom of the paint can free of paint and for spreading materials such as putty and the like. The blade is provided with a hook designed to receive a correspondingly shaped notch or hole in the sleeve for affixing the two. By altering the width and length of the blade and sleeve, sleeves of idela size for pint, quart, gallon and five gallon containers may be utilized economically.

40 Claims, 2 Drawing Sheets

LIQUID MIXING PADDLE HAVING DISPOSABLE SLEEVE

BACKGROUND OF THE INVENTION

1. Field of the Invention

The present invention relates generally to liquid mixing paddles and more specifically to a liquid stirring tool which provides a disposable sleeve member for significantly reducing the cost while increasing the usefulness of such tools as compared to the prior art.

2. Prior Art

Because of the chemical nature of water-based and oil-based paints, it is often necessary to stir the paint in the can prior to removing any material from the container in order to provide a relatively homogeneous consistency of paint with a uniform color throughout. Manually mixing the paint is an especially important process after the paint has had an opportunity to settle for some period of time and therefore separate in an inhomogeneous manner such as when the paint can has been used before and it is being reopened for further use of a remaining portion of the contents. Paint stirrers and mixing paddles intended for this purpose have been available for many years.

U.S. Pat. No. 2,524,475 to Renz is directed to a paint mixing paddle for stirring paint. The paddle provides a body having a hook-shaped lug for prying the lids from paint cans and a flat shank portion for stirring the paint. However, this tool does not provide for a mallet portion for reclosing paint cans, nor does it provide a disposable stirring sleeve. U.S. Pat. No. 2,528,128 to Forster is directed to a multipurpose tool serving a plurality of functions. The tool includes a flat body portion having an integrated elongated handle having one side provided with indicia for serving a measurement purpose. The tool includes a mallet portion and a screw driver bit portion at the outer end of the handle, which could serve to open a can. However, a disposable stirring sleeve is not provided in this system.

U.S. Pat. No. 2,931,259 to Nicot is directed to a device for removing covers from paint cans and for stirring paint. The paddle includes a lever attachment coupled on one end. The lever attachment has an extended lip portion for use in prying open the paint cans. However, this system does not include a mallet portion for closing the lids nor a disposable sleeve.

U.S. Pat. No. 4,553,279 Gassew is directed to a multipurpose paint stick for use by a painter. The paint stick is formed by a flat rectangularly shaped material having a straight edge along which markings are provided to indicate equal distances of length. Thus, the paint stick may be used as a measuring device for mixing paints, and for stirring paint. However it is not provided with a disposable sleeve or with means to open or close paint cans.

U.S. Pat. No. 4,580,302 to Barth is directed to a painter's tool for use in opening and closing paint cans. The multi-purpose tool includes a shank which extends from a handle to a flat tip, shaped like a screw driver bit, for the removing paint can lid. However, the tool does not include a mallet portion for closing the lid. It is provided instead with a C-shaped clamp member and a contact member for closing the lid by leverage. No disposable sleeve is disclosed.

As can be seen from the aforementioned patents constituting the relevant prior art known to the applicant herein, many of the disclosed paint mixing tools serve multiple purposes, such as providing a specially shaped edge which can be used to pry open the can lid. One inherent problem associated with all such paint mixing tools is that as part of their ordinary and anticipated use, they are usually covered with a layer of paint. Unless this paint is washed off the surface of the tool, which can be a tedious process if it is done each time the tool is used, the paint on the surface, often precludes its use a second time unless the paint is thoroughly dried. Consequently, it is usual for paint mixing paddles and the like to be treated as disposable tools which are used once and once only for mixing paint and then disposed of. In addition, unless such paddles are disposed of immediately, they pose a storage problem due to wet paint which may contaminate anything in which they come in contact.

This type of tool therefore raises the issue of cost. More specifically, irrespective of how inexpensive the tool might be, by virtually requiring that there be a separate tool for each color paint used and having the user dispose of the tool immediately after each such use, renders the cost of the tool a critical parameter. In this regard, it should be noted that a number of paint manufacturers and others in the painting industry have at times provided promotional items in the form of wooden paint mixing paddles upon which they print their trademarks and other identifying indicia in order to promote the sale of their more expensive items. Of course, the cost associated with such giveaway promotional items is even more critical to the companies which employ this technique for advertising because that cost detracts directly from the bottom-line profit of the other items being advertised. Furthermore, the print used on such items for advertising purposes can and often does interfere with the painting process. More specifically, it is not uncommon for the print to mix with the print and alter the color thereof, which can have a deleterious effect on the public relations the giveaway paddle is designed to improve. Also, because a rigid yet cheap material such as low grade wood is most often used, such printing or advertising is of poor and barely legible quality at best. Also, as a matter of practicality, only one size stick is provided for all can sizes.

Accordingly, there has been a long felt need for a paint stirring tool properly dimensioned for different can sizes and which provides a disposable characteristic, but which is of extremely low cost and which preferably incorporates a device for printing trademarks and other indicating indicia of paint manufacturers and the like which will not interfere with the paint color and be sharp, crisp and legible including small print and detail.

SUMMARY OF THE INVENTION

The present invention solves the aforementioned long felt ne*ed by providing a disposable jacket stirring tool system comprising two elements, one of which is disposable, the other not requiring cleaning. More specifically, a first element of the present invention is designed to be non-disposable, that is, designed to be reused without incurring the deficiencies and problems associated with the prior art as previously noted. This element comprises a steel or plastic blade which in a preferred embodiment provides a handle or mallet portion and has a prying end for opening paint can lids. The blade also provides a notch for hooking a jacket or sleeve which comprises the second element of the invention. The jacket or sleeve is preferably made of a relatively inexpensive material such as paper, plastic or foil.

The interior surface of the sleeve is preferably plastic coated for preventing the paint or other liquids from soaking through the paper and reaching the blade. The coating also increases the strength of the material to allow the jacket to serve other paint-related purposes as will be hereinafter more fully described. Furthermore, the plastic coated paper is, as a result of the heat sealable plastic used on the interior surface thereof, more easily formed in an enclosing jacket configuration which provides a pocket which may be positioned over the accompanying blade. The sleeve is secured thereto by means of a notch received by a hook on the blade.

Unlike the prior art, the present invention is designed to provide a very low cost and readily disposable jacket portion which prevents any paint from reaching the underlying blade, thereby rendering it more likely for the user to reuse the blade portion of the invention while disposing of the jacket portion thereof. In addition, the jacket portion in a preferred embodiment of the invention is designed to provide advertising space for promotional purposes in a location which is unlikely to result in a mixture of the print material and the paint, thereby precluding the disadvantageous contamination of the paint by the print as found in prior art devices. Furthermore, the jacket may be specially shaped to provide level indicatons of the paint remaining in the can and also to provide a lip which can be used for collecting paint underneath the lip of the can thereby increasing paint usage efficiency. Furthermore, the edge or tip of the jacket of the present invention can be tapered or chiseled to provide a spreading tool as well as an edge for properly mixing thicker material adhering to the bottom surface of the container.

OBJECTS OF THE INVENTION

It is therefore a principal object of the present invention to provide a paint mixing paddle or stirring tool which substantially reduces or entirely overcomes the noted deficiencies of the prior art.

It is an additional object of the present invention to provide a paint mixing paddle or stirring tool system comprising two elements, one of which is of low cost and thus readily disposable material and configuration designed to shield the second element from becoming contaminated with paint.

It is still an additional object of the present invention to provide a paint mixing paddle or stirring tool comprising an elongated blade made of steel or plastic and which may be readily adapted for providing a curved end for prying open the lid of paint cans and which may be readily provided with a handle or mallet portion and which is adapted for interconnection to a second element comprising a low cost jacket or sleeve, the latter being designed for disposal and replacement without requiring disposal of the entire tool.

It is still an additional object of the present invention to provide a paint mixing paddle or stirring tool which is particularly well suited for providing clear and legible printed advertising space wherein the print thereof cannot contaminate the paint during the use of the tool.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
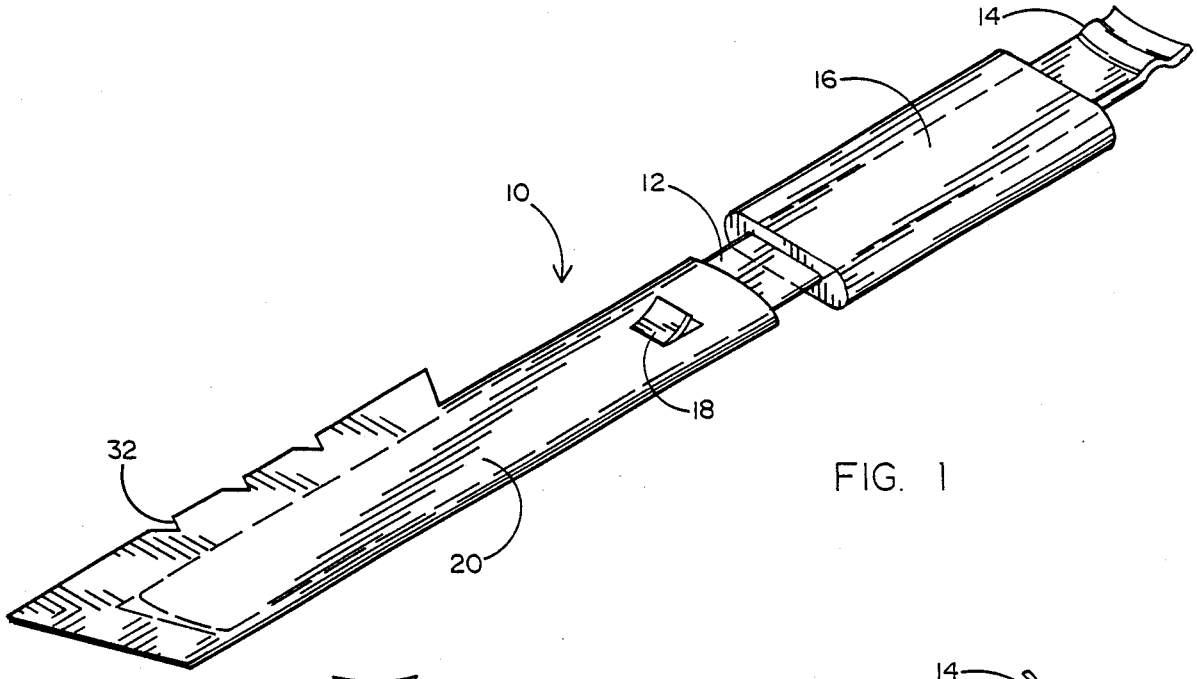
FIG. 1 is an isometric view of the tool of the present invention.
Figure 2:
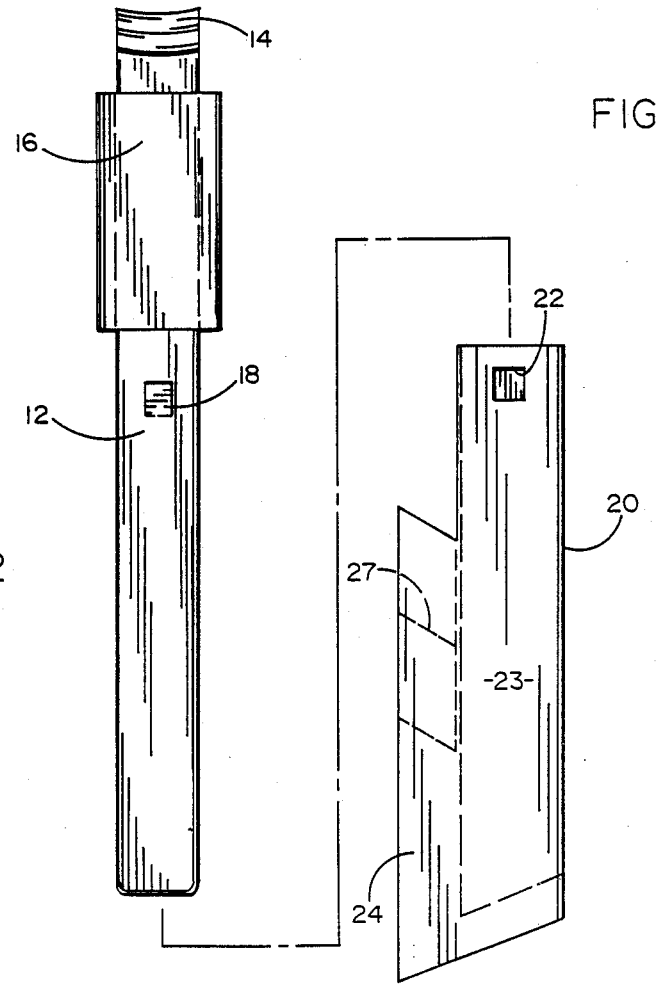
FIG. 2 is an elevational front view of the tool of the present invention showing the sleeve porton thereof disconnected from the blade portion thereof.
Figure 3:
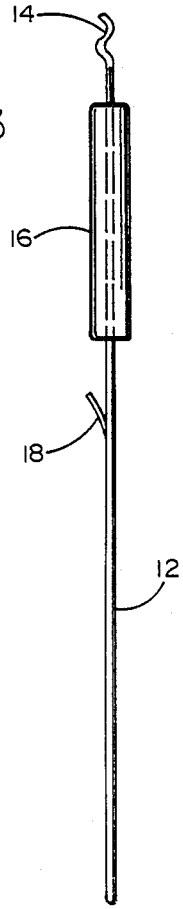
FIG. 3 is a side-view of the blade portion of the present invention.

Reference being made to FIGS. 1 and 2, it will be seen that the mixing tool system 10 of the present invention, comprises an elongated blade 12, one end of which is shaped by means of curvature in two planes to form a prying end 14. The blade is provided with a handle 16 of generally rectangular configuration and preferably made of a shock-resistant plastic such as polypropylene so that the handle 16 may be alternatively used as a mallet for resealing the lid of a paint can and the like after it has been opened. Immediately below the handle 16 there is provided a hook 18 which may be readily provided by notching out three sides of a rectangular cutaway portion of the blade 12 and bending that portion outwardly as seen best in FIGS. 1 and 3. It will be seen hereinafter that hook 18 is designed to secure the sleeve of the present invention to the blade.

The portion of blade 12 below handle 16 is designed to receive a sleeve 20 as shown in FIG. 2. Sleeve 20 is preferably made of a low cost, readily disposable material such as a heavy gauge paper, preferably coated with a plastic material such as polyethylene to prevent the paint or other liquid with which mixing tool 10 is used, from soaking through the paper surface which would allow it to otherwise contaminate the surface of blade 12. The preferred embodiment of sleeve 20, shown herein in the accompanying drawings comprises a jacket portion 23 and a flat portion 24. The uppermost region of the jacket portion is provided with hook notches 22 for being received by hook 18 of blade 12 to provide a convenient means for securing sleeve 20 to the blade.

Figure 4:
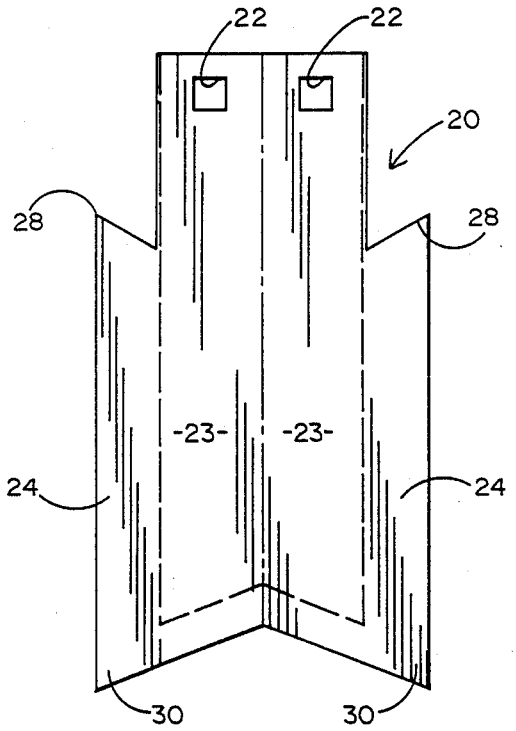
FIG. 4 is an elevational view of the sleeve portion of the present invention shown in its unfolded planar configuration.

As seen in FIG. 4 which shows the sleeve 20 in its flat unfolded configuration, the jacket portion 23 is of a substantially rectangular configuration and is partially surrounded by a border forming the flat portion 24. In the preferred configuration of the sleeve 20 shown in FIG. 4, the upper ends of the flat portion 24 are canted to provide a lip wipe 28 and lower ends of the flat portion 24 are canted in the opposite direction to provide a chisel taper 30. As previously indicated, the entire surface of sleeve 20 seen in FIG. 4, which constitutes the interior surface of the sleeve, is preferably coated with a plastic material such as polyethylene which serves multiple purposes. One such purpose is to increase the material strength of the sleeve 20. Another such purpose is to provide a material which may be heat sealed for affixing together the folded flat portions 24. An additional such purpose is to prevent the paint or other liquid from soaking through the sleeve and contaminating the blade 12.

Figure 5:
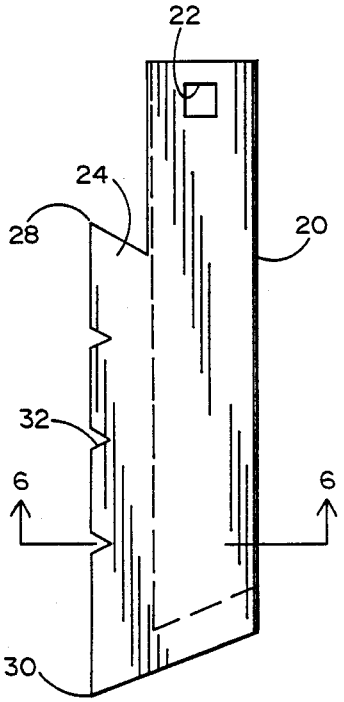
FIG. 5 is an elevational front-view of the sleeve portion of the present invention shown in its folded configuration.
Figure 6:
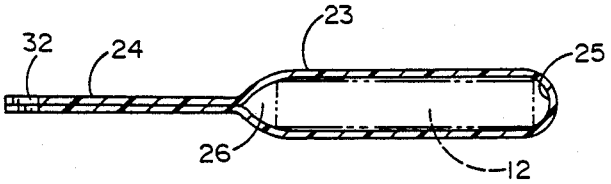
FIG. 6 is a cross-sectional view of the folded sleeve portion of the present invention taken along lines 6—6 of FIG. 5.

The folded configuration of the sleeve 20 is shown in FIGS. 5 and 6. As seen best in FIG. 6, when the sleeve of FIG. 4 is folded, the jacket portion 23 forms an interior pocket 26 adapted to receive the blade 12 in the manner shown in FIG. 1. On the other hand, the flat portion 24 is formed by contiguous engagement of the respective flat portions shown in FIG. 4, preferably sealing one against the other by applying heat to melt the polyethylene or other plastic coating on the inside surface of the sleeve. The inside coating 25 within the chamber 26 forms a barrier between the sleeve and the blade whereby to prevent contamination of blade in the manner previously described. In its folded configuration, sleeve 20 provides the aforementioned lip wipe 28 and chisel taper 30 as seen best in FIG. 5. Lip wipe 28 provides the user with a convenient means for wiping paint or other liquid from the interior surface of the paint can adjacent the lip to assure the user that no significant amount of paint or other liquid is contained therein and otherwise inaccessible. On the other hand, the chisel taper 30 provides a convenient additional tool surface which may be used for spreading such materials as wall spackle and putty.

While the physical dimensions of the tool 10 of the present invention may be selected to provide the most convenient configuration for the user and for the capacity and shape of the paint cans or other liquid containers with which the tool is used, it will be understood that such dimensions are not necessarily limiting of the present invention. However, in the preferred mode of the present invention it has been found advantageous to provide a tool which is sufficiently long to enable the sleeve to cover a variety of different paint can capacities. In this regard, the flat portion 24 of sleeve 20 may be provided with a plurality of scored lines 27 seen in FIG. 2, each score line corresponding to the standard depth of paint in gallon, quart and pint containers respectively. The scored lines permit easy removal of a portion of the flat portion 24 of sleeve 20 to reduce the length of the flat portion to accommodate the various sizes of paint cans. In addition, the flat portion 24 of sleeve may be provided with a plurality of notches such as triangular shaped notches 32 shown in FIGS. 1 and 5. The position of the notches 32 can be readily calibrated for most standard sized paint cans to provide a non-print representaton of the level of the paint within the container. Thus for example, the notches could be calibrated to indicate a quarter, half and three-quarter level of a gallon paint can with the top of the lip wipe 28 corresponding to a full container. Using such notches instead of printing to provide a calibrated representation of the remaining paint within the can, precludes the disadvantageous print contamination of the paint color previously described. Nevertheless, the unique and advantageous configuration of the disposable sleeve 20 still permits the use of advertising print on the tool 10 immediately below the notch 22 on the exterior surface of sleeve 20. When appropriately dimensioned, the sleeve 20 provides a non-paint contaminated area above the top of lip wipe 28 and below the lower portion of notch 22 upon which manufacturers and distributors can readily print their advertising for distribution of the tool or the sleeve portion thereof without fear of inadvertently causing contamination of the paint color by a mixture of the print ink and the paint as previously described with respect to the prior art.

After the tool system 10 of the present invention has been used for example, for mixing paint, as previously described, the sleeve 20 may be readily removed from the blade 12. Removal is effected by simply applying a laterally directed, opposed force to each side of the sleeve along the edges of the blade adjacent the hook 18 to expand the pocket 26 until the notches 22 are released by the hook 18. The disposable sleeve 20 may be then readily slid from the blade 12 and replaced with a clean, new sleeve 20. Consequently, the present invention is readily reused with only the low cost disposable sleeve portion thereof disposed of and without requiring or causing the user to handle any wet paint that may have adhered to the outside surface of the sleeve below the level corresponding to lip wipe 28.

It will now be understood that what has been disclosed herein comprises a novel and highly advantageous mixing tool system for use with paint cans and the like, the mixing tool comprising a blade having, in a preferred embodiment, a prying end and a handle which can serve the additional purpose of a mallet. The remaining portion of the blade is adapted for insertion into the pocket of a disposable sleeve, preferably made of paper coated with polyethylene or other coating. The paper sleeve provides a jacket portion adapted to encircle the blade and a flat portion which may be used for a variety of purposes including calibrating the level of the paint in the can, as well as providing specially shaped edges for wiping the interior lip of the paint can free of paint and for spreading materials such as putty and the like. The blade is provided with a hook designed to receive a correspondingly shaped notch in the paper sleeve for affixing the two. Unlike the prior art noted herein, the mixing tool of the present invention is unlikely to break, is readily adapted for cans of different sizes, serves more than just the purpose of stirring the paint, gives the user additional tool use capabilities, such as getting into corners and the like, and provides a highly useful and efficient tool of which only a relatively inexpensive portion is disposable, thereby substantially improving the cost effectiveness of such tools.

Those having skill in the art to which the present invention pertains, will now as a result of the applicant's teaching herein, perceive various modifications and additions which may be made to the invention. By way of example, the precise shape and relative configurations of the blade and sleeve portions of the present invention may be readily altered while still achieving the objectives and advantages thereof. Accordingly, all such modifications and additions are deemed to be within the scope of the invention which is to be limited only by the claims appended hereto.

I claim:

1. A tool comprising:

a blade portion having a handle region and an elongated member extending from said handle region;

a sleeve portion having a pocket for receiving said elongated member in surrounding engagement therewith;

means for removeably affixing said blade portion to said sleeve portion for removal and replacement of said sleeve portion;

said sleeve portion comprising a flat border along at least one edge of said pocket, said border having a rigid tapered corner for use as a tool element.

2. The tool recited in claim 1 wherein said sleeve portion comprises a foldable material folded on itself to form said pocket.

3. The tool recited in claim 2 wherein said foldable material is coated with a liquid impervious coating.

4. The tool recited in claim 2 wherein said foldable material is selected from the group consisting of paper, plastic and metal foil.

5. The tool recited in claim 3 wherein said coating is plastic.

6. The tool recited in claim 5 wherein said plastic is polyethylene.

7. The tool recited in claim 1 wherein said blade portion comprises a curved edge for prying up the lid of a container.

8. The tool recited in claim 1 further comprising a mallet head formed integrally with said blade along said handle region.

9. The tool recited in claim 1 wherein said affixing means comprises a hook extending from said blade portion and a notch in said sleeve portion, said notch having a shape and dimension for receiving said hook.

10. A tool comprising:

a blade portion having a handle region and an elongated member extending from said handle region;

a sleeve portion having a pocket for receiving said elongated member in surrounding engagement therewith;

means for removeably affixing said blade portion to said sleeve portion for removal and replacement of said sleeve portion;

said sleeve portion comprising a flat border along at least one edge of said pocket, said border having at least one notch for calibrating the quantity of a liquid.

11. The tool recited in claim 10 wherein said sleeve portion comprises a foldable material folded on itself to form said pocket.

12. The tool recited in claim 11 wherein said foldable material is coated with a liquid impervious coating.

13. The tool recited in claim 11 wherein said foldable material is selected from the group consisting of paper, plastic and metal foil.

14. The tool recited in claim 12 wherein said coating is plastic.

15. The tool recited in claim 14 wherein said plastic is polyethylene.

16. The tool recited in claim 10 wherein said blade portion comprises a curved edge for prying up the lid of a container.

17. The tool recited in claim 10 further comprising a mallet head formed integrally with said blade along said handle region.

18. The tool recited in claim 10 wherein said affixing means comprises a hook extending from said blade portion and a notch in said sleeve portion, said notch having a shape and dimension for receiving said hook.

19. A tool comprising:

a blade portion having a handle region and an elongated member extending from said handle region;

a sleeve portion having a pocket for receiving said elongated member in surrounding engagement therewith;

means for removeably affixing said blade portion to said sleeve portion for removal and replacement of said sleeve portion;

said sleeve portion comprising a flat border along at least one edge of said pocket, said border having removeable portions for calibrating the quantity of a liquid.

20. The tool recited in claim 19, wherein said border comprises a rigid edge for use as a spreading and scraping tool.

21. The tool recited in claim 19 wherein said sleeve portion comprises a foldable material folded on itself to form said pocket.

22. The tool recited in claim 21 wherein said foldable material is coated with a liquid impervious coating.

23. The tool recited in claim 21 wherein said foldable material is selected from the group consisting of paper, plastic and metal foil.

24. The tool recited in claim 22 wherein said coating is plastic.

25. The tool recited in claim 24 wherein said plastic is polyethylene.

26. The tool recited in claim 19 wherein said blade portion comprises a curved edge for prying up the lid of a container.

27. The tool recited in claim 19 further comprising a mallet head formed integrally with said blade along said handle region.

28. The tool recited in claim 19 wherein said affixing means comprises a hook extending from said blade portion and a notch in said sleeve portion, said notch having a shape and dimension for receiving said hook.

29. A stirring tool of the type used for stirring paint in a can, the tool comprising:

a blade portion having a handle region and an elongated member extending from said handle region;

a sleeve portion having a pocket for receiving said elongated member in surrounding engagement therewith;

means for removeably affixing said blade portion to said sleeve portion for removal and replacement of said sleeve portion;

said sleeve portion comprising a paper material folded on itself to form said pocket.

30. The tool recited in claim 29 wherein said paper material is coated with a liquid impervious coating.

31. The tool recited in claim 29 wherein said foldable material is selected from the group consisting of paper, plastic and metal foil.

32. The tool recited in claim 30 wherein said coating is plastic.

33. The tool recited in claim 32 wherein said plastic is polyethylene.

34. The tool recited in claim 29 wherein said sleeve portion comprises a flat border along at least one edge of said pocket, said border having a rigid tapered corner for use as a tool element.

35. The tool recited in claim 29 wherein said sleeve portion comprises a flat border along at least one edge of said pocket, said border having at least one notch for calibrating the quantity of a liquid.

36. The tool recited in claim 29 wherein said sleeve portion comprises a flat border along at least one edge of said pocket, said border having removeable portions for calibrating the quantity of a liquid.

37. The tool recited in claim 29 wherein said blade portion comprises a curved edge for prying up the lid of a container.

38. The tool recited in claim 29 further comprising a mallet head formed integrally with said blade along said handle region.

39. The tool recited in claim 29 wherein said affixing means comprises a hook extending from said blade portion and a notch in said sleeve portion, said notch having a shape and dimension for receiving said hook.

40. The tool recited in claim 29 wherein said blade comprises a rigid edge for use as a spreading and scraping tool.

* * * * *